US007581689B2

(12) United States Patent
Schenk

(10) Patent No.: US 7,581,689 B2
(45) Date of Patent: Sep. 1, 2009

(54) DEVICE FOR PROCESSING EXCAVATED MATERIAL

(76) Inventor: Jürgen Schenk, Hausmannstr, 34, 70188 Stuttgart (DE)

( * ) Notice: Subject to any disclaimer, the term of this patent is extended or adjusted under 35 U.S.C. 154(b) by 515 days.

(21) Appl. No.: 11/371,417

(22) Filed: Mar. 9, 2006

(65) Prior Publication Data

US 2006/0157598 A1 Jul. 20, 2006

Related U.S. Application Data

(63) Continuation-in-part of application No. PCT/EP2004/010032, filed on Sep. 8, 2004.

(30) Foreign Application Priority Data

Sep. 10, 2003 (DE) ..... 203 14 137

(51) Int. Cl.
*B07B 13/00* (2006.01)
*B07C 7/00* (2006.01)
*B02C 13/00* (2006.01)
*B02C 17/02* (2006.01)

(52) U.S. Cl. ..... 241/79; 241/154; 241/155

(58) Field of Classification Search ..... 241/79, 241/155, 154

See application file for complete search history.

(56) References Cited

U.S. PATENT DOCUMENTS

| | | | | | |
|---|---|---|---|---|---|
| 3,070,318 | A | * | 12/1962 | Blanchard | 241/14 |
| 3,332,627 | A | * | 7/1967 | Hinton | 241/24.14 |
| 3,353,947 | A | * | 11/1967 | Kramer | 71/21 |
| 5,271,168 | A | | 12/1993 | Wilson, Sr. et al. | |
| 5,513,807 | A | * | 5/1996 | Stricker | 241/23 |
| 5,769,333 | A | * | 6/1998 | Kimura et al. | 241/24.18 |
| 5,921,706 | A | | 7/1999 | Manatt et al. | |
| 6,129,300 | A | * | 10/2000 | Heukamp et al. | 241/191 |
| 6,402,070 | B1 | | 6/2002 | Ishida et al. | |

FOREIGN PATENT DOCUMENTS

| | | |
|---|---|---|
| DE | 101 11 305 A1 | 6/2002 |
| DE | 202 14 956 U1 | 11/2002 |

* cited by examiner

*Primary Examiner*—Bena Miller
(74) *Attorney, Agent, or Firm*—R. S. Lombard; K. Bach

(57) ABSTRACT

In an arrangement for processing excavated materials including a material crushing device and a classifier to which the crushed material is supplied for screening, the classifier includes a leveling structure which provides for a desired orientation of the classifier relative to a horizontal plane independently of the orientation of the crushing device.

16 Claims, 4 Drawing Sheets

DEVICE FOR PROCESSING EXCAVATED MATERIAL

This is a continuation-in-part application of international application PCT/EP2004/010032 filed Sep. 8, 2004 and claiming the priority of German application 203 14 137.7 filed Sep. 10, 2003.

BACKGROUND OF THE INVENTION

The invention relates to a device for processing excavated material including a crushing device disposed above a screening structure.

German Utility Model DE 202 14 956 U1 discloses a crushing device with two shafts rotating in opposite directions and provided with crushing discs. The crushing device is suitable for crushing, for example, mineral materials, for example, ground, coarse gravel, stones, or other materials. The materials can be crushed down to particle sizes of 10 mm to 60 mm.

Furthermore, DE 101 11 305 A1 discloses an apparatus for processing mineral materials, particularly excavated ground which may include brittle, coarse components. For the crushing, a gapping structure consisting of two shafts is provided, which shafts rotate in opposite directions and which carry pointed bits. The bits are intended to crack the coarse components in order to initiate the crushing. This may occur in the pressure of binding materials such as clay. The coarse components are crushed to a particle size of about 60 mm. The powder or fine particle content is small.

The material produced in this way is suitable, as a result of the crushing of the coarse components thereof, basically for re-installation, that is, for example, for the filling of excavated areas such as pits or ditches. However, it is necessary to add to this material filler materials such as cement, ashes, stones powder, fibers, wood chips, saw dust, suspensions such as limestone suspensions, bentonite or other dense suspensions.

It is the object of the present invention to provide an improved device for processing excavated materials.

SUMMARY OF THE INVENTION

In an arrangement for processing excavated materials including a material crushing device and a classifier to which the crushed material is supplied for screening, the classifier includes a leveling structure which provides for a desired orientation of the classifier relative to a horizontal plane independently of the orientation of the crushing device.

The material to be processed which includes coarse components is subjected to a crushing process wherein the coarse components are crushed and mixed with the rest of the material. The crushing is preferably accomplished in a very whereby components capable of binding the particulate material are formed. The process is operated in a way such that the components capable of binding the particulate material, which are normally finely crushed parts act as filler materials so that the need for an addition of filler materials such as cement, lime, fibers, wood chips, etc. is eliminated. The fine particle components required for the form-stabilization, drying and/or the solidification of the processed materials are therefore provided by the material being processed itself during the crushing of the coarse material. This material may already be naturally present in the material to be processed in the form of rock pieces (limestone, sandstone or other rocks). But it is also possible to add such coarse materials to materials which do not include the needed components, such as clay-type excavation material, before the processing.

However, the coarse material in this case is not an additive in the conventional sense as, by itself, it does not have binding functions. This property is obtained only by the crushing or, respectively milling procedure in the crushing device. The coarse material is fed through the crushing or milling device together with the excavated soil. It has been found that the process can be so controlled that, in spite of the presence of the excavated soil or another corresponding mineral material with clay-like components, a sufficient amount of the fine components can be produced during the crushing of the coarse material. The fine components are then mixed with clay-like components during the crushing procedure and act as added materials. The coarse components provide during crushing for the binding capability particularly well if they are partially pulverized during the crushing. However, the particulate coarse material may also be ground separately.

An additive which improves the binding capability such as cement, lime, dusts, seeds or nuts/nut shells can additionally be added to the material being processed preferably before the crushing or grinding but it may also be admixed afterward. The amount of additive required, however, is substantially smaller as it would be without the crushing or grinding of coarse components. The crushed coarse components have particularly the capability of binding water and therefore increase the stability and carrying capability of the processed material if it is used for example for the filling of excavated ditches without provoking an undesirable subsequent hardening of the material. If the carrying capability of the processed material is obtained only by the addition of cement the material becomes too hard so that a later opening of the ditch becomes difficult. With the present invention the need for additional materials can in many cases be lowered to less that 0.5 wt %. With a water content of up to 30% and a rock content of about 50% generally no additional binding materials are needed.

If the material to be processed is a binding material, that is if it contains pliable water-containing solid materials such as clay, the rock powder formed during the crushing acts as an additive material. The rock powder may have different binding properties depending on its chemical constitution. It may, for example, be water absorbing. It may furthermore have stabilizing or solidifying effects by ion-exchange processes. It may further have a porrolanic binding effect. It may also have a binding effect by absorption of water, for example, it is contains hydrate components. Furthermore, it may form hydrate binding which may be established by microcrystal growth. This is particularly the case, if a coarse material, concrete or other construction waste materials are used. Generally, such construction waste materials shall include unsaturated components and consequently, have a residual binding capability. Furthermore, after the fine-milling or crushing re-crystallization processes may result in the establishment of renewed solidification.

The material may also be so dry that it can be screened. It has been found that larger stones still present after the crushing can be sifted out without essential adherences of clay or the like.

Particularly advantageous are crushing devices with asymmetrical discs for the accommodation of tools.

In a particularly preferred embodiment according to the invention, the crushing device is in the form of a milling cutter which is disposed above a screening structure such as a roller classifier, a sieve or a separator. The screening structure is provided with a leveling device by which the screening structure can be maintained in a predetermined orientation. If for example, a horizontal orientation is to be maintained and the device for processing the excavated material is moved, the screening structure automatically maintains its horizontal orientation. This is particularly important because the screening occurs with the co-operation of gravity. The leveling device makes it possible to construct the crushing device as a movable unit or as an arrangement of several movable units.

The invention will become more readily apparent from the following description of an advantageous embodiment thereof on the basis of the accompanying drawings.

DESCRIPTION OF THE ADVANTAGEOUS EMBODIMENTS

Figure 1:
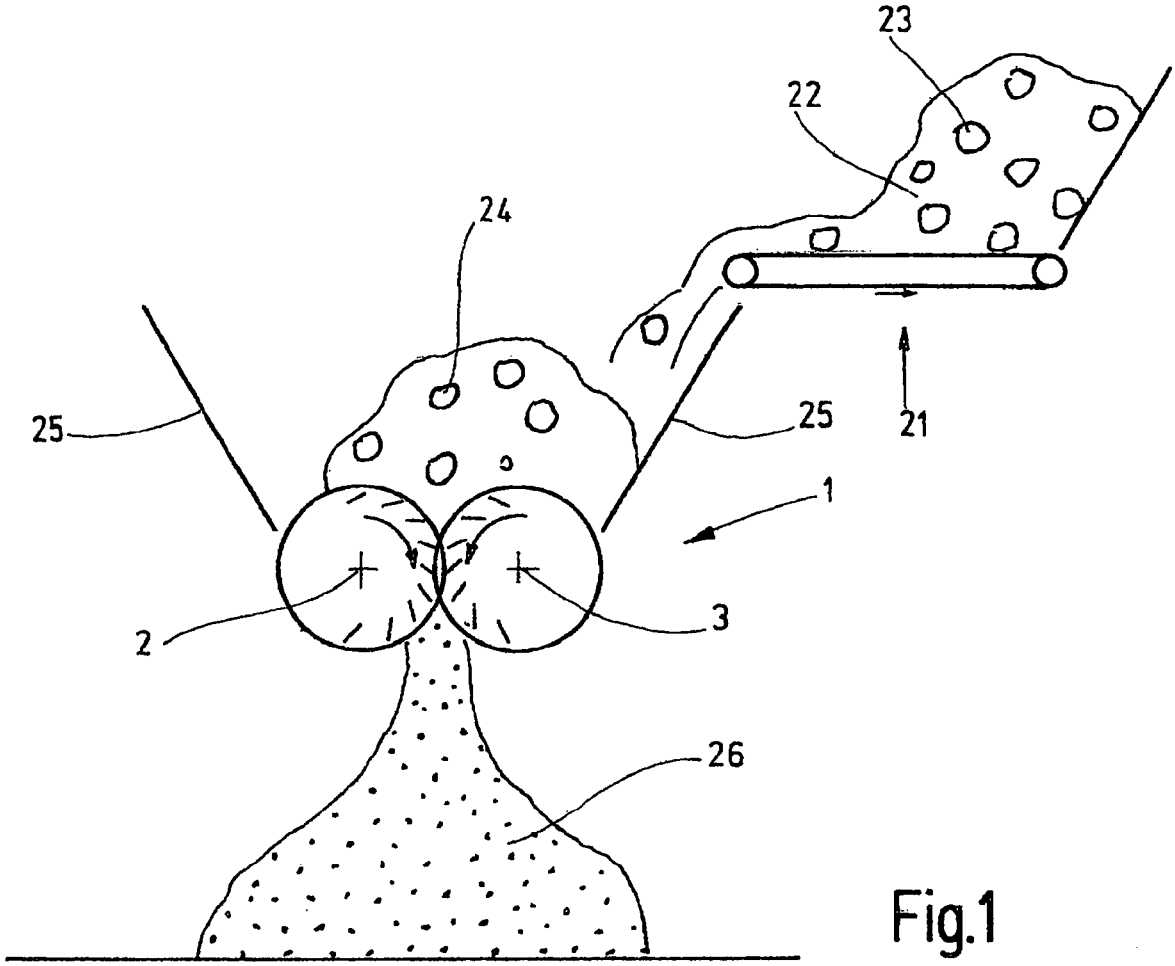
FIG. 1 shows schematically a device for processing excavated materials including a crushing device.

FIG. 1 shows a crushing device 1 which serves as a diminution-, milling- and coarse pieces crushing device.

Figure 3:
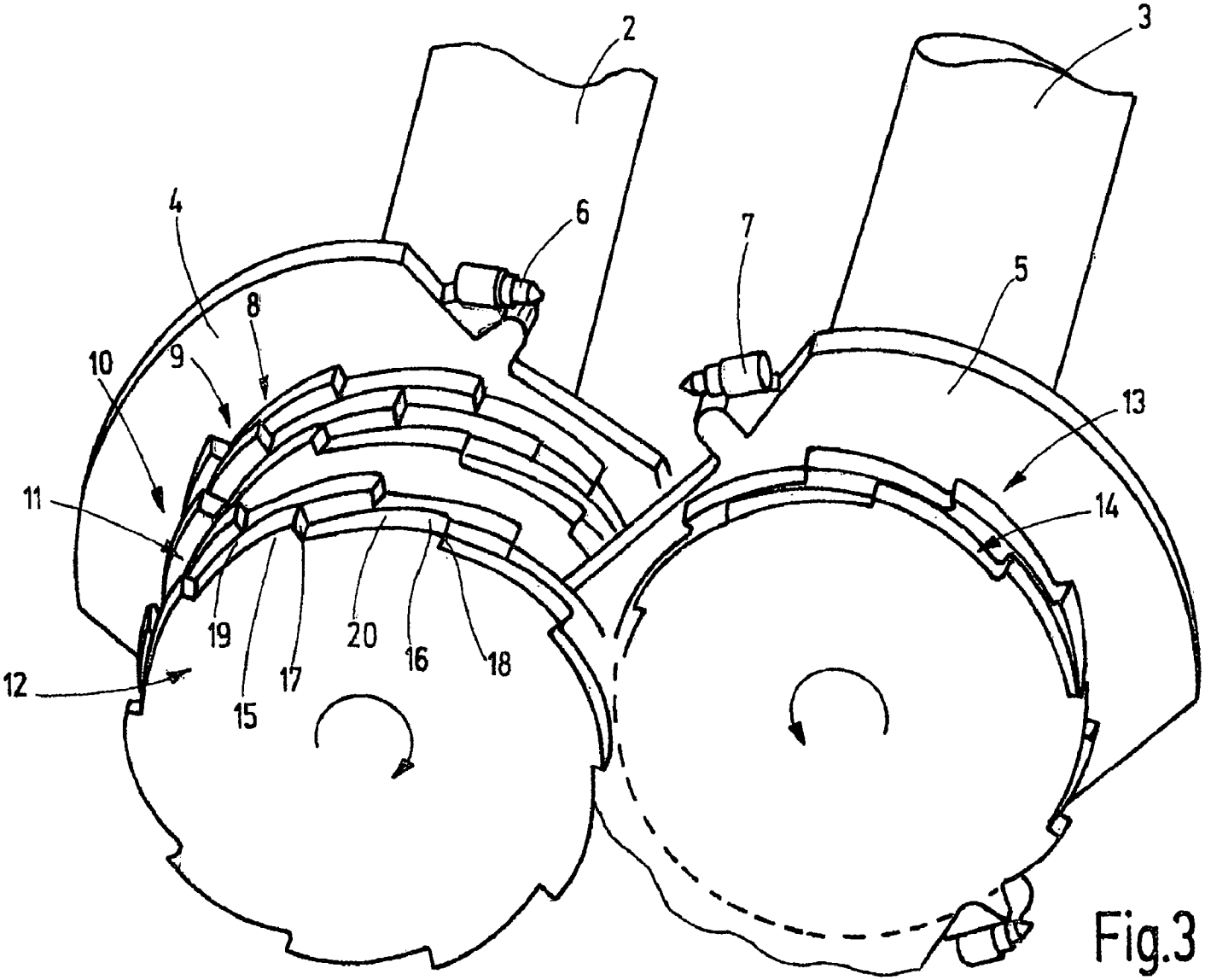
FIG. 3 shows in a partial perspective view the crushing device of FIG. 1 or 2.

The device comprises for example, two shafts 2,3 rotating in opposite directions with crushing tools mounted on the shafts 2,3. The crushing tools may be, for example, in the form as shown in DE 101 11 305 A1 or in DE 202 14 956 U1. Other then shown in these patent documents the crushing tools are however so adjustable that not only a piece size of 60 mm is obtained, but that at least part of the coarse pieces are crushed to a much greater degree. This can be achieved in various ways. In this regard, reference is made to FIG. 3. FIG. 3 shows the shafts 2, 3 in a perspective view. They carry axially displaced discs 4, 5 which are provided at their circumferences with recesses in which break-up chisels 6, 7 are supported. The recesses may have the same or different shapes. The break-up chisels 6, 7 preferably have conical tips which move toward each other above a plane defined by the axes of the two shafts 2, 3. The respective opposite directions of rotation of the two shafts 2,3 are indicated in FIG. 3 by arrows. Stones engaged between the tips of the break-up chisels 6, 7 are broken by the movement of the chisels toward each other by the slowly rotating shafts (for example about 10 to 60 rpm). Interfering materials possibly present such as wood, steel cans, tires are either processed or they are rejected.

Otherwise, toothed discs 8 to 14 are disposed on the shafts 2, 3 adjacent one another in axially spaced relationship. They may all have the same shape or they may be differently shaped. The teeth 15, 16 have radially extending front faces 17, 18 and receding back areas 19, 20. The toothed discs 8 to 14 are arranged on the shafts 2,3 so as to provide spaces there between into which the toothed discs of the opposite shaft extend. The number of toothed discs 8-14 is preferably larger than the number of discs provided with chisels (discs 4, 5).

The teeth of the discs are so arranged that it is disposed opposite on essentially cylindrical pressure surface portion between circumferentially adjacent teeth of the disc of the opposite shaft forming a pressure gap for the crushing of the coarse material components. But the toothed discs 8 to 14 of the two shafts may also be arranged closely adjacent one another and have a diameter such that the enveloping circles of the toothed discs 8 to 14 of the two shafts 2, 3 do not intersect. Rather they are so selected that between the tooth backs of the booth discs of the two shafts 2, 3 remains a small gap which serves as a compression gap.

The crushing device of FIG. 1 also includes a drive arrangement for the two shafts 2, 3 comprising for example two hydraulic motors, one for each shaft 2, 3. both hydraulic motors may be powered by a common diesel engine. Above the coupling device 1 there is furthermore a transport device 21 which transports a material mixture 22 to the crushing device 1 as shown schematically in FIG. 1. The material mixture 22 is for example excavated soil of clay-like constitution. It contains coarse components in the form of stones 23, 24. They may be contained naturally in the material mixture 22 or they may be added as needed. The stones 23, 24 may be bricks, concrete blocks, natural stones (limestone, sandstone, granite, basalt, gneiss, tuff, parphyry or similar). Also a mixture of different stones, gravel, sand or similar materials may be used. The material mixture 22 is fed by the transport device 21 to the crushing device 1 where it may be collected in a collection funnel 25 disposed above the crushing device 1.

During operation of the crushing device 1, the crushing tools carried by the two shafts 2, 3 engage the clay-cohesive material and moves it downwardly. Furthermore the stones 23, 24 split and broken up by the break-up bits or chisels 6, 7 (FIG. 3). Then the broken pieces are further crushed by the toothed discs 8 to 14, wherein the process is so controlled that a high proportion of small particles is generated. The crushing procedure results partially in the milling of the stones to fine powder. The stone powder formed hereby (quartz powder, lime powder, etc.) is instantly mixed with the clay like material of the material mixture 22. If the clay like material sticks to the toothed discs 8 to 14, it is carried once around and subjected to an even more intense mixture with the stone powder. In this way, a largely homogenized solubilized material 26 is formed consisting of ground stones, particulate components and clay-like base material. This material mixture is generally suitable for immediate re-installation at the construction site (highway construction).

The stone powder content generated during the crushing procedure results at least in an absorption of moisture and therefore in an instant reduction of the stickiness and the kneadability of the material. Over a larger period this stone powders tend to harden also if they are formed in the crushing procedure described above in a moist environment. The hardening or solidification process may be based on ion exchange processes, the formation of pozzolanic bindings or hydration processes. The material is suitable to a low-pore compression and in this way becomes capably of carrying high loads. The binding components of the mixture ensure that, upon re-excavation of ditches or the excavation of new ditches adjacent to filled in ditches the walls of the ditches are very stable.

Figure 2:
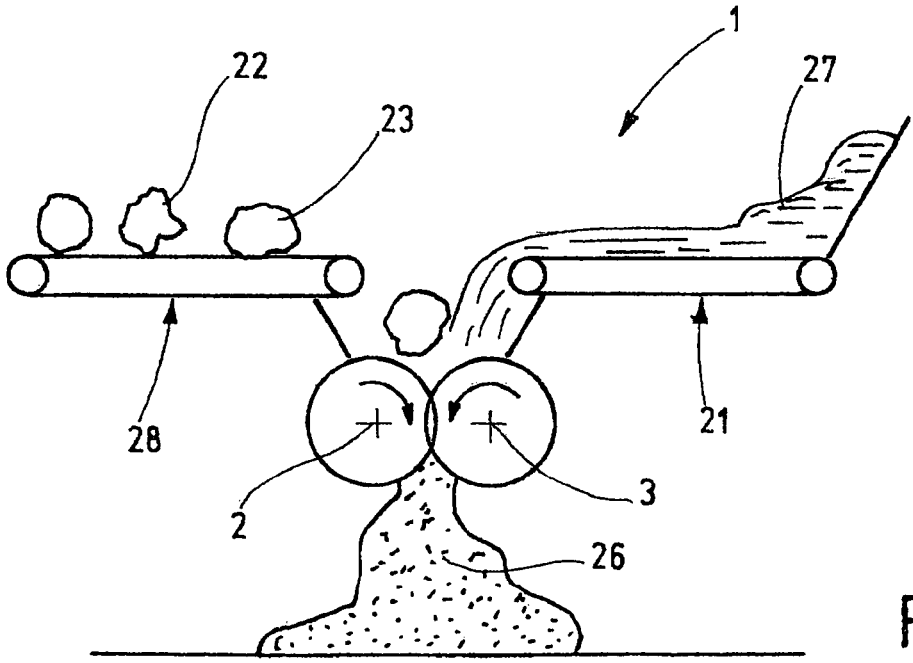
FIG. 2 shows schematically wherein excavated material and coarse components are separately supplied to a crushing device.

The crushing device 1 as shown in FIG. 2 is particularly suitable for the processing of material 27 of clay-like base structure without coarse material components. The needed coarse material that is stones 22, 23 can be supplied by an additional transport device 28 to the crushing device which is formed by the two shafts 2, 3 with the break-up discs 4, 5 and the toothed discs 8-14. In this way, the supply of the material 27 and of the stones 22, 23 can be accurately controlled. The stones 22, 23 are generally construction waste materials that is concrete pieces, brick-waste or other demolition material, but they may also be natural stones.

The stones 22, 23 are crushed in the crushing device in the presence of the material 27 whereby the stone powder generated is homogenously mixed with the material 27. The material mixture 26 formed in this way is suitable for installation at the construction site.

Figure 4:
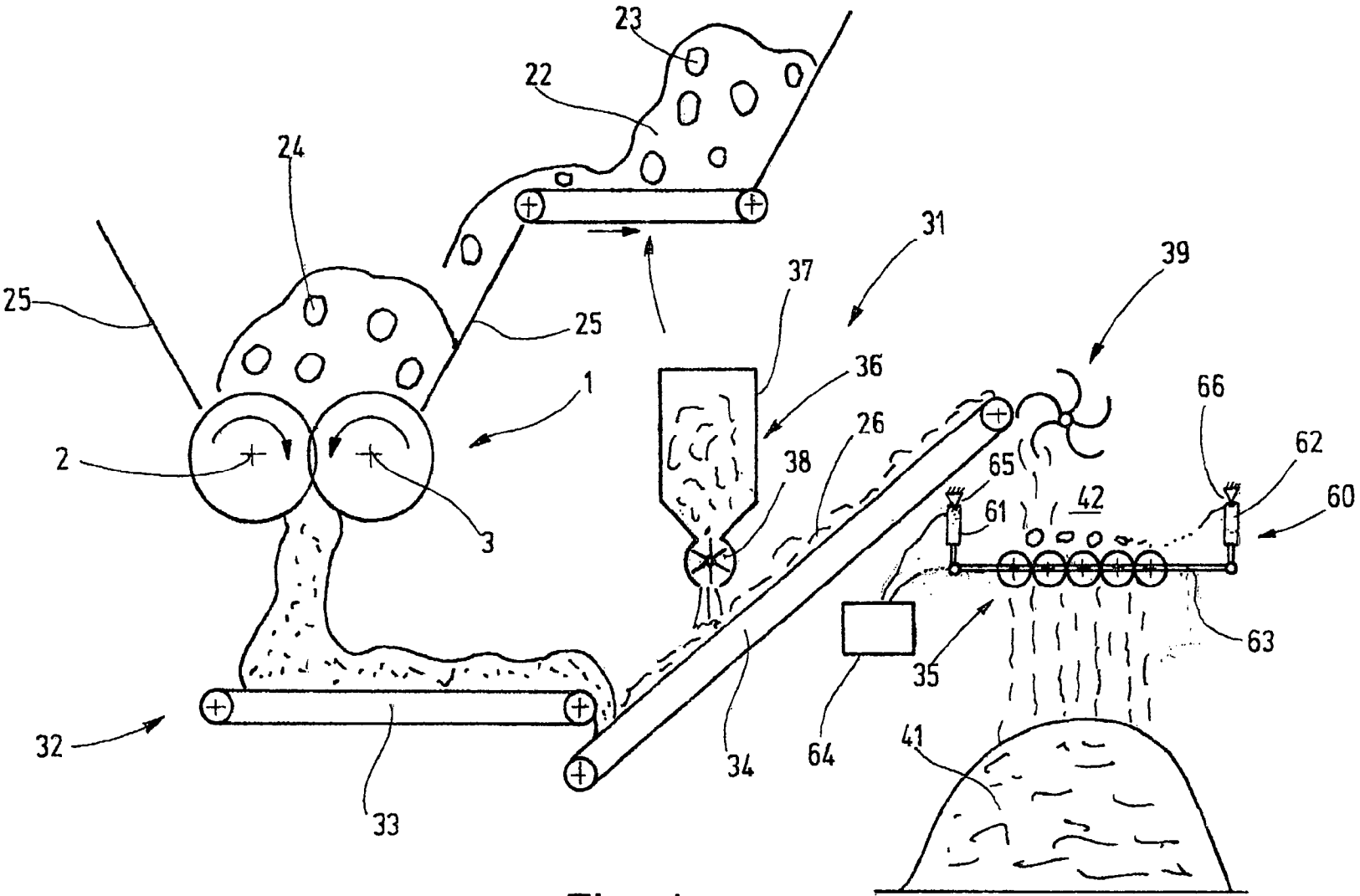
FIG. 4 shows a modified arrangement showing schematically leveling arrangement; and, FIG. 5 shows a mixing device with an adjustable secondary crushing structure.

The processing arrangement as illustrated in FIG. 4 comprises the crushing device 1 as shown in FIG. 1 and described earlier in connection with FIG. 1 which is supplemented by a supplemental treatment arrangement 31. The supplemental treatment arrangement 31 comprises a transport device 32 with two conveyors 33, 34 which supply the material 26 that has been homogenized in the crushing device 1 to a roller classifier 35. Above one of the conveyers 33, 34 a dosing apparatus 36 is arranged by way of which additive materials such as cement are supplied to the homogenized construction materials on the conveyers 33, 34. The dosing apparatus comprises for example a storage container 37 and a cell wheel sluice 38 disposed at the outlet of the container 37. Between the conveyor 34 and the roller classifier 35, a transport wheel or a supplemental milling device 39 may be arranged which takes up the material supplied by the conveyor 34 and distributes it on the roller classifier 35. The roller classifier comprises a group of round or oval rollers which rotate in the same or opposite sense and between which the material 26 supplied to the classifier 35 passes downwardly and is collected on a pile 41. Coarse components such as insufficiently crushed stones 42 are discharged from the roller classifier 35 to one side and may be taken for further processing.

The closing apparatus 36 is preferably so adjusted that it supplies only relatively small amounts of additional materials that is amounts of less than 0.5 wt % of the materials transported by the conveyor 33, 34. Also a control device may be provided which determines this dose depending on the residual moisture in the material 26. A corresponding moisture measuring device may be provided, however is not shown in FIG. 4. For the processing of sludge, however, the dosage of additional material may be increased above the normal value.

Figure 5:
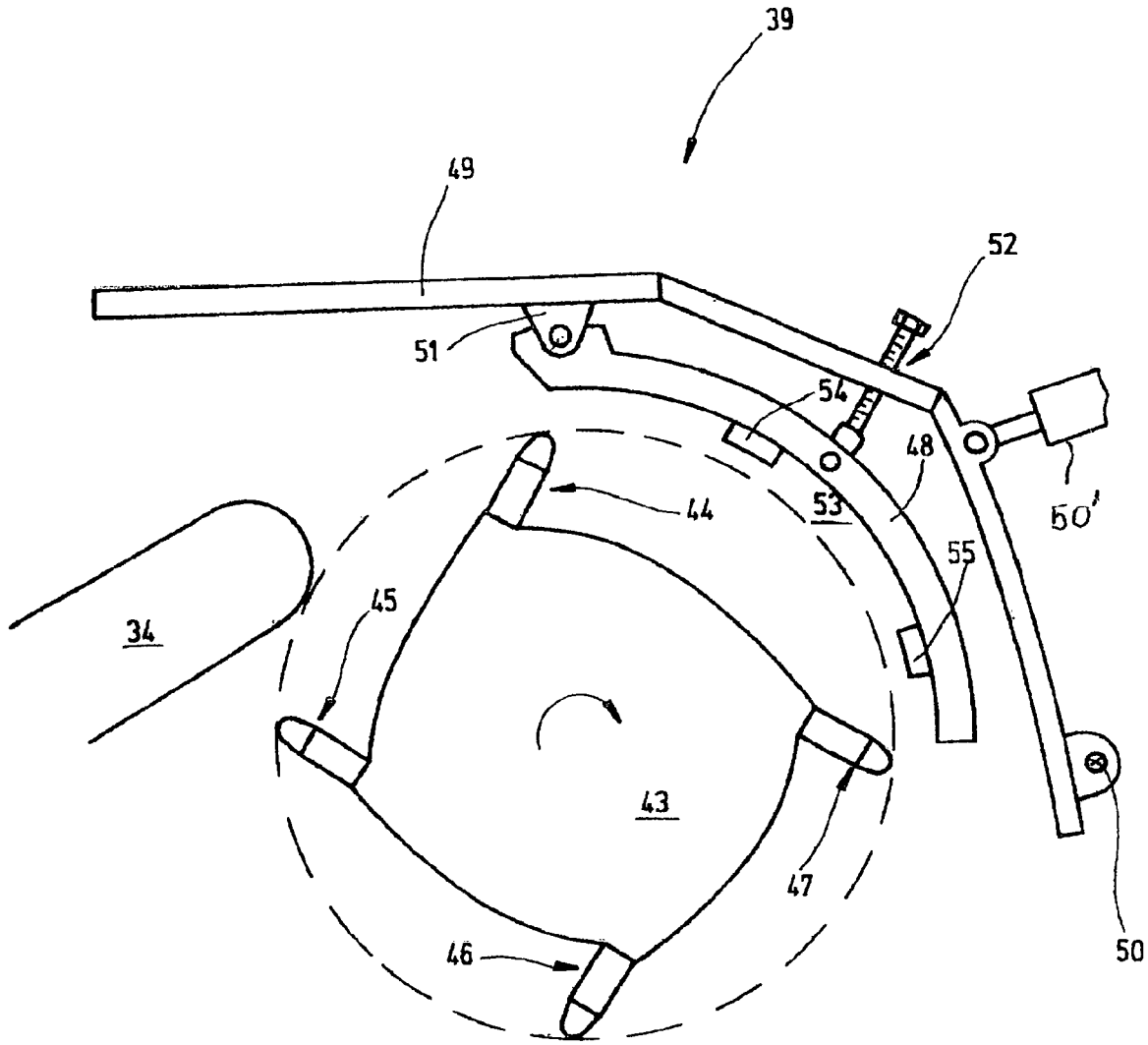

FIG. 4 shows schematically a transport wheel 39 which preferably forms a mixing device with an additional supplemental crushing function as shown in greater detail in FIG. 5. It includes a motor 43 preferably with a horizontal axis of rotation which is driven by a hydraulic motor or any other drive means. The motor 43 preferably extends over the full width of the conveyor 34 shown in FIG. 4. At its circumference it is provided with tools such as bits or chisels 44, 45, 46, 47, which are inclined in the direction of rotation. Preferably chisel bits with rounded heads are used. However, other bits such as flat tip bits or suitable hammer bits may be used. Preferably the bits 44 to 47 are rigidly mounted. However, particularly with the use of hammer bits they may be supported so as to be pivotable about a pivot axis which extends parallel to the axis of rotation of the motor 43. The motor 43 in most cases is designed for a rotational speed of 200 to 1000 rpm. Preferably its speed is 400 rpm.

The motor 43 is covered by a hood 48 which is arranged above the motor 43 at the side thereof opposite the conveyor 34. Preferably, the hood 48 covers the motor 43 over about a quarter of its circumference. It is pivotally supported on a support hood 49 which is mounted so as to be pivotable about an axis 50. A hydraulic cylinder 50' is connected to the support hood 49 for opening an closing the support hood 49. The motor 43 may be supported by the conveyor 34 or by a frame which carries both the motor 43 and the conveyor 34. The hood 48 is supported by the support hood 49 by a bearing structure 51. This pivot axis is disposed above the motor 43. The pivot position of the hood 48 is determined by an adjustment mechanism in 52, for example, in the form of a simple adjustment bolt or in the form of fluid, that is hydraulic or pneumatic cylinders.

The hood 48 is curved so as to extend about parallel to the circle of movement of the bits 44, 45, 46, 47. It delimits therefore with the motor 43 a gap-shaped crushing space 53. If necessary one or two impact webs 54, 55 may be provided on the hood 48 which extends over the full length of the motor 43 and project toward the motor 43.

The mixing device 39 provides for further mixing and crushing of the material supplied by the conveyor 34. The particle size can be adjusted by the adjustment mechanism 52 as desired. As a result a highly homogenous material is supplied to the roller classifier 35.

In accordance with the invention, for the processing of excavation materials or of other materials which may be provided for re-installation at a construction site or another type of processing or for waste management, a crushing process is provided wherein excavated materials and additionally coarse pieces are moved through the crushing, milling and jamming material removal arrangement. The stone powder formed during crushing of the coarse material by suitable crushing an/or compression procedures is used as locally produced additive material for mixture with the excavated soil. This additive material is suitable for controlling the moisture of the excavated soils or sludge as well as stabilizing and solidifying the excavated material so that it becomes stable. Also granulated formation is possible. The degree of drying and solidification can be adjusted by the degree of crushing or milling for example by a more or less intense milling of the coarse material components depending on the moisture content or the desired subsequent solidification. Furthermore, coarse components such as asphalt, construction waste, concrete pieces or natural stones may be added to the excavated material so as to obtain during the crushing procedure the desired stone powder amount. The crushing-milling and jamming material removal arrangement breaks down any destructible jamming material and prevents the passage of coarse jamming materials which can not be crushed. Those material parts are rejected. For example, large steel parts are not engaged by the crushing wheels or they result in a blockage and reversal of the machine. Overloading of one or multiple reversals result in a shut-down of the device.

The plant as shown in FIG. 4 which includes a separation device 35 in the form of roller classifier or another material separation apparatus, is provided with a leveling arrangement 60. This arrangement comprises electrical or hydraulic actuators 61, 62 which support the classifier structure 63. The actuators 61, 62 are preferably so connected to the classifier structure that they can adjust the inclination of the classifier in the longitudinal direction as well as in the transverse direction. The actuators 61, 62 are supported at their other ends, for example, on a machine frame which also supports the conveyor 34, and the mixing or milling device 39 but which is not shown. A control unit 64 is connected to the actuators 61, 62 for operating the actuators appropriately. To this end the control unit 64 senses the inclination of the classifier frame 63. In addition the control unit is connected to input means by which an operator can enter a desired inclination of the frame 63. If for example, an inclination of 5 degrees with respect to the horizontal is desired this value is entered by the operator. The control unit then causes the adjustment of the actuators 61, 62 such that this inclination is maintained also if the whole plant changes its position that is also when the support points 65, 66 for the actuators 61, 62 are displaced by movement of the plant. The leveling arrangement 60 ensures that the classifier 35 can properly perform also under difficult operating conditions as they frequently occur in the practical operation at construction sites.

Driving the material processing furthermore ahead of or subsequent to, the main crushing procedure, a preliminary or, respectively, follow-up crushing may be provided for and liquid such as water or an aqueous solution may be added to the material between the individual crushing stages. Water may be added for example to enhance the binding of the added material or the powder material formed during crushing. The absorption of liquid by the addition of powdered dry material or the moistening of the material by addition of water is controlled on the basis of the initial moisture content of the material.

In accordance with the invention, the classifier is for example a roller classifier connected to a leveling structure which ensures a desired orientation of the classifier independently of a movement or the set-up of the whole arrangement. The desired orientation may be horizontal or inclined. By ensuring the desired orientation the classifier reliably can fulfill the classification task to be performed by it. As a result the classifier can be used in connection with pivotable or movable processing plants wherein, after a position change no manual adjustment of the classifier is necessary as it is automatically maintained at the desired inclination entered by the operator.

What is claimed is:

1. An arrangement for processing excavated materials comprising: a first material crushing device (39), a classifier (35) disposed below the crushing device, said classifier (35) including means for adjusting the inclination of the classifier (35) in the longitudinal direction and the transverse direction relative a horizontal plane independently of the orientation of the crushing device (39).

2. The arrangement according to claim 1, further including a transport device (32) operatively connected to the first crushing device (39) for the controlled supply of coarse material to the first crushing device (39).

3. The arrangement according to claim 2, wherein the transport device (32) includes conveyors (33, 34).

4. The arrangement according to claim 3, further including a dosing apparatus (36) arranged above one of the conveyors (33, 34), the dosing apparatus (36) comprising an additive material storage container (37), the container (37) having an outlet, a cell wheel sluice (38) disposed at the outlet of the container (37).

5. The arrangement according to claim 3, wherein the first material crushing device (39) further includes a motor (43) operatively associated with the conveyor (34), second tools (44, 45, 46, 47) affixed to the motor (43) at its circumference, a hood (48) arranged above the motor (43) proximate a side opposite conveyor (34), a support hood (49) including a bearing structure (51), an adjustment mechanism (52) operatively connected to the hood (48) for adjusting the position of the hood (48) relative to the motor (43) to delimit a gap-shaped crushing space (53).

6. The arrangement according to claim 5, further comprising impact webs (54, 55) affixed to the hood (48).

7. The arrangement according to claim 1, wherein the first crushing device (39) is a milling cutter.

8. The arrangement according to claim 1, wherein a second main crushing device (1) is disposed ahead of the first crushing device (39).

9. The arrangement according to claim 8, wherein the second main crushing device (1) includes means for breaking coarse material components.

10. The arrangement according to claim 9, wherein the second main crushing device (1) further includes a means for generating material powder from the broken coarse material components.

11. The arrangement according to claim 9, wherein the means for breaking coarse material components comprises at least one shaft with break-up discs (4, 5) carrying crushing tools (6, 7).

12. The arrangement according to claim 11, wherein the crushing tools (6, 7) carried by the break-up discs (4, 5) comprise break-up bits arranged on front walls of a recess formed in each break-up disc (4, 5).

13. The arrangement according to claim 8, wherein the crushing device (1, 39) is a multi-stage crushing device.

14. The arrangement according to claim 1, wherein the means for adjusting the inclination of the classifier (35) in the longitudinal direction and the transverse direction relative a horizontal plane independently of the orientation of the crushing device (39) include actuators (61, 62), a frame structure (65, 66) affixed to and in supportive relationship with the actuators (61, 62), the classifier (35) further includes a classifier frame (63), the actuators (61, 62) affixed to and operatively connected to the classifier frame (63) for adjustment of the inclination of the classifier frame (63).

15. The arrangement according to claim 14, wherein the means for adjusting the inclination of the classifier (35) in the longitudinal direction and the transverse direction relative a horizontal plane independently of the orientation of the crushing device (39) further includes a control unit (64) operatively connected to the actuators (61, 62), the control unit (64) including a means for sensing the inclination of the classifier frame (63), the control unit (64) also including an input means for accepting manual entry of a desired inclination of the classifier frame (63) and an output means for causing the adjustment of the actuators (61, 62) in the longitudinal direction and transverse direction to the desired inclination and for maintaining the desired inclination even if the frame structure (65, 66) is displaced.

16. The arrangement according to claim 1, wherein the classifier (35) is a roller classifier.

* * * * *